US007871266B2

(12) United States Patent
Kisoda

(10) Patent No.: US 7,871,266 B2
(45) Date of Patent: Jan. 18, 2011

(54) OVEN APPARATUS AND SEASONING METHOD USED THEREWITH

(75) Inventor: Kinya Kisoda, Osaka (JP)

(73) Assignee: Chugai Ro Co., Ltd. (JP)

( * ) Notice: Subject to any disclaimer, the term of this patent is extended or adjusted under 35 U.S.C. 154(b) by 1062 days.

(21) Appl. No.: 11/630,450

(22) PCT Filed: Feb. 14, 2005

(86) PCT No.: PCT/JP2005/002149

§ 371 (c)(1),
(2), (4) Date: Dec. 21, 2006

(87) PCT Pub. No.: WO2006/001098

PCT Pub. Date: Jan. 5, 2006

(65) Prior Publication Data

US 2007/0207433 A1 Sep. 6, 2007

(30) Foreign Application Priority Data

Jun. 24, 2004 (JP) ..... 2004-187101

(51) Int. Cl.
*F27B 9/04* (2006.01)

(52) U.S. Cl. ..... 432/212; 432/152

(58) Field of Classification Search ..... 432/121, 432/144, 145, 149, 150, 152, 177, 178, 212; 165/47, 49, 53; 217/131
See application file for complete search history.

(56) References Cited

U.S. PATENT DOCUMENTS

| | | | | |
|---|---|---|---|---|
| 2,091,979 | A * | 9/1937 | Hamlink | 432/212 |
| 2,983,022 | A * | 5/1961 | Dressler et al. | 264/37.14 |
| 4,770,630 | A * | 9/1988 | Akimoto et al. | 432/121 |
| 4,863,374 | A * | 9/1989 | Vukovich, Jr. | 432/121 |
| 6,261,091 | B1 * | 7/2001 | Sakamoto et al. | 432/121 |
| 6,382,964 | B2 * | 5/2002 | Sakamoto et al. | 432/171 |

FOREIGN PATENT DOCUMENTS

| | | |
|---|---|---|
| CN | 2135729 Y | 9/1988 |
| JP | 05-005124 A | 1/1993 |
| JP | 09-152279 A | 6/1997 |
| JP | 2002-373586 | 12/2002 |

* cited by examiner

*Primary Examiner*—Gregory A Wilson
(74) *Attorney, Agent, or Firm*—DLA Piper LLP (US)

(57) ABSTRACT

An oven apparatus including wall members which constitute an oven wall defining internal and external regions of an oven and partition walls forming oven compartments within the oven by defining internal and external regions thereof, the wall members including an inner wall panel facing an internal side of the oven or oven compartment, an outer wall panel facing the external side of the oven or oven compartment, and thermal insulation installed between the inner and outer wall panels, wherein a sealable ventilation port is formed on the inner wall panel, a sealable suction port is formed on the outer wall panel, and a suction-generator is connected to the suction port for evacuating the atmosphere within the wall member.

6 Claims, 3 Drawing Sheets

OVEN APPARATUS AND SEASONING METHOD USED THEREWITH

RELATED APPLICATION

This is a §371 of International Application No. PCT/JP2005/002149, with an international filing date of Feb. 14, 2005 (WO 2006/001098 A1, published Jan. 5, 2006), which is based on Japanese Patent Application No. 2004-187101, filed Jun. 24, 2004.

TECHNICAL FIELD

This disclosure relates to oven apparatus and seasoning methods able to maintain cleanliness of an internal oven environment which is devoid of contaminants released from insulation during a seasoning operation, to reduce the need to clean an internal region of the oven after the seasoning operation is performed, and to effectively remove contaminants released from the insulation during a significantly shortened seasoning time regardless of a temperature differential between the internal and external oven environments.

BACKGROUND

For an industrial oven used for heat-treatment and other like processes, in case an internal part of an oven is thermally insulated from an external environment and the oven is partitioned into various oven compartments thermally separated each other for the thermal control requirements, oven and partition walls are constructed in the form of the thermal insulation structures. Japanese Unexamined Patent Publication No. 2002-373586 describes an insulating structure installed to the exhaust cart of a continuous heat treating oven used to seal the hollow flat panel applied to a plasma display screen, the insulting structure being used to cover and thermally insulate the opening in the oven floor. That type of conventional oven insulating structure consists of hollow oven walls or partition walls into which thermal insulation is installed.

It is known that heating the thermal insulation material generally results in various substances forming or including the insulation material being gasified and discharged from the insulation into the local environment. It is imperative that impurities should be kept out of the internal environment of the oven which is used in the plasma display panel heating process. However, in case such a thermal insulation material is installed in the oven wall and partition wall, the internal oven environment is polluted. A means of overcoming this problem has been to run the oven through a break-in operation called "seasoning." The heat generated during the break-in operation has the effect of previously releasing contaminants from the insulation material so that the internal oven environment will remain clean during the subsequent production heat treating operation.

There is, however, a problem associated with this break-in operation in that the insulation releases pollutants into the oven environment during seasoning, thus necessitating that the oven be cleaned before it can be used in the production heat treating process.

Moreover, due to the thermal insulation being installed within the walls having internally and externally facing surfaces, the externally facing surface is at a lower temperature than the internally facing surface during the seasoning operation when the thermal insulation is heated. This requires that the oven is seasoned for an extended length of time in order that the thermal insulation in proximity to the externally facing surface is heated to an extent which allows a sufficient amount of contaminants to be released. If sufficient seasoning time is not allowed, an adequate amount of contaminants will not be discharged from the thermal insulation. Measures have been taken to solve this problem by covering the externally facing surface of the walls with another insulation or by raising the temperature of the externally facing surface using a heater or blowing hot air thereon. These measures, however, increase costs and complicate operation.

Despite the application of the aforesaid measures, the internal environment of the oven must still be cleaned after the break-in operation. Running the oven for an extended break-in period, insulating the oven walls, and separately heating the oven walls are tasks which place an additional burden on oven operation in terms of time, operating cost, and labor.

Another method of rectifying the problem of insufficient contaminant release has been to prevent contaminants from discharging from the insulation into the oven by fabricating the wall members as gas-tight structures. This method, however, has the disadvantage of further increasing the cost of the oven.

It would therefore be advantageous to provide an oven apparatus capable of maintaining cleanliness of an internal oven environment which is devoid of contaminants released from the insulation during the seasoning operation, eliminating the need to clean the internal region of the oven after the seasoning operation is performed, and effectively removing contaminants released from the insulation during a significantly shortened seasoning time regardless of the temperature differential between the internal and external oven environments.

SUMMARY

This disclosure relates an oven apparatus including wall members which constitute an oven wall defining internal and external regions of an oven and partition walls forming oven compartments within the oven by defining internal and external regions thereof, the wall members including an inner wall panel facing an internal side of the oven or oven compartment, an outer wall panel facing the external side of the oven or oven compartment, and thermal insulation installed between the inner and outer wall panels, wherein a sealable ventilation port is form on the inner wall panel, a sealable suction port is formed on the outer wall panel, and a suction-generator is connected to the suction port for evacuating the atmosphere within the wall member.

This disclosure also relates a seasoning method utilized in conjunction with an oven apparatus comprising wall members which constitute an oven wall defining internal and external regions of an oven and partition walls forming oven compartments within the oven by defining internal and external regions thereof, the wall members having an inner wall panel facing the internal side of the oven or oven compartment, an outer wall panel facing the external side of the oven or oven compartment, and thermal insulation installed between the inner and outer wall panels, wherein a sealable ventilation port is installed on the inner wall panel of the wall members, a sealable suction port is installed on the outer wall panel of the wall members, the method including evacuating the atmosphere within the wall member through a suction-generator connected to the suction port in open condition of the ventilation port and suction port, during a seasoning operation.

DETAILED DESCRIPTION

Figure 1:
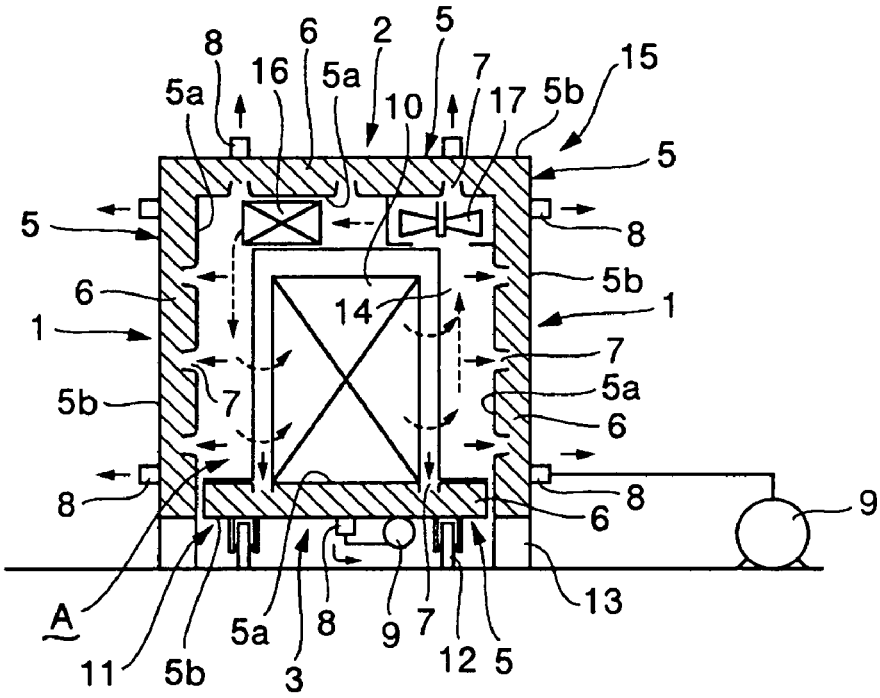
FIG. 1 is a front view cross-section of a cart-type oven apparatus.

It will be appreciated that the following description is intended to refer to specific examples of structure selected for illustration in the drawings and is not intended to define or limit the disclosure, other than in the appended claims.

The oven apparatus is characterized by wall members which constitute an oven wall defining internal and external regions of an oven and partition walls forming oven compartments within the oven by defining internal and external regions thereof. The wall members include an inner wall panel facing the internal side of the oven or oven compartment, an outer wall panel facing the external side of the oven or oven compartment, and thermal insulation installed between the inner and outer wall panels. A sealable ventilation port is formed on the inner wall panel, a sealable suction port is formed on the outer wall panel, and a suction-generating means is connected to the suction port as means of evacuating the atmosphere within the wall member.

The oven apparatus is further characterized by a bending part attached to the ventilation port. The bending part conceals the thermal insulation within the wall member from the internal region of the oven or oven compartment.

The oven apparatus is further characterized by a ventilated cover installed over the ventilation port and suction port.

The oven apparatus is still further characterized by a thru-passage formed in the thermal insulation as a duct connecting the ventilation port and suction port.

The oven apparatus is yet further characterized by a ventilating space formed between the thermal insulation and outer wall panel of the wall member and connected to the suction port as means of providing ventilation through which the temperature of the thermal insulation is increased.

Moreover, the seasoning methods utilized in conjunction with an oven apparatus comprises wall members which constitute an oven wall defining internal and external regions of an oven and partition walls forming oven compartments within the oven by defining internal and external regions thereof, the wall members having an inner wall panel facing the internal side of the oven or oven compartment, an outer wall panel facing the external side of the oven or oven compartment, and thermal insulation installed between the inner and outer wall panels. The sealing method is characterized by using a sealable ventilation port installed in the inner wall panel of the wall members, a sealable suction port installed in the outer wall panel of the wall members, and having a step of evacuating the atmosphere within the wall member through suction-generating means connected to the suction port in open condition of the ventilation port and suction port, during a seasoning operation.

In consideration of the efforts by others, I provide oven apparatus and seasoning methods capable of maintaining cleanliness of an internal oven environment devoid of contaminants released from the thermal insulation during the oven seasoning operation, eliminating the need to clean the internal area of the oven after the seasoning operation is completed, and effectively removing contaminants released from the insulation material during a short seasoning time regardless of the temperature differential between the internal and external oven environments.

Figure 2:
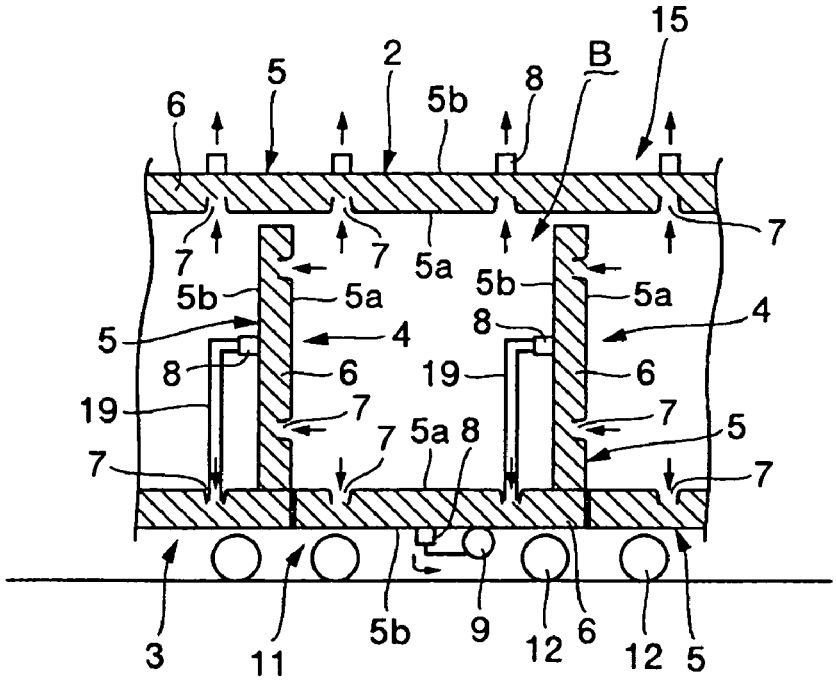
FIG. 2 is a side view cross-section of a cart-type oven apparatus.

The following provides a detailed description of the oven apparatus and seasoning method with reference to the attached drawings. As illustrated in FIG. 1 and FIG. 2, this oven apparatus comprises an oven wall in the form of side parts 1, ceiling part 2, and oven floor part 3 which define the internal and external regions of an oven space 'A', and partition walls 4 which define the internal and external regions of an internal oven compartment 'B'. The oven wall and partition walls 4 are constituted of the wall member 5 which include inner panels 5*a* which face the internal regions of the oven space 'A' or oven compartment 'B', and outer panels 5*b* which face the region external to the oven space 'A' or oven compartment 'B'. The internal space formed between the inner panel 5*a* and the outer panel 5*b* of the wall member 5 is filled with thermal insulation 6. Sealable ventilation ports 7 are formed within the inner panels 5*a* of wall members 5, sealable suction ports 8 are formed within the outer panels 5*b* of wall members 5, and suction means 9, which creates a partial vacuum within the internal space of the wall members 5, is connected to the suction ports 8.

The oven apparatus is embodied as cart-type oven wherein a cart 11, which carries a hollow flat panel 10 such as that used in a plasma display, traverses through the heated environment of oven space 'A' which has the effect of sealing the flat panel 10 and removing any gasses held therein. FIG. 1 describes a frontal view of one example of the cart-type oven, and FIG. 2 describes a side view cross section of another example of the oven.

The oven apparatus described in FIG. 1 comprises the cart 11 which moves on traverse wheels 12 while carrying the hollow flat panel 10, an oven structure 15 primarily comprising ceiling part 2 and left and right side parts 1 supported by leg parts 13, the ceiling and side parts enveloping the cart 11, a circulation baffle 14 which efficiently guides the circulation of the atmosphere within the internal oven environment, an oven floor part 3 which is an integral part of the cart 11 defines the oven space 'A', together with the oven structure 15, and a heater 16 and circulation fan 17 installed beneath the ceiling part 2. The atmosphere within the oven space 'A' is heated by the heater 16, forcefully circulated by the circulation fan 17, and guided by the baffle 14 throughout the interior of the oven structure 15, for the purpose of heat treatment to the hollow flat panel 10, during the time that the flat panel 10 traverses there through.

Another type oven apparatus shown in FIG. 2 has the oven compartment 'B' formed by the partition wall 4 which extends upward from the oven floor part 3 of the cart 11 toward the ceiling part 2 of the oven structure 15. The oven compartment 'B' is thus formed within oven space 'A' between two adjacent carts 11 by the partition walls 4.

The oven wall of the oven structure 15 which is comprised of side parts 1, ceiling part 2, and oven floor part 3 and partition wall 4 of the cart 11 is structured by wall members 5. All of wall members 5 are formed to a reasonable thickness as hollow box-like structures constructed of heat-resistant metal enclosing an internal region filled with thermal insulation 6, a substance commonly known in the art. Wall members 5, which comprise side parts 1, ceiling part 2, oven floor part 3, and partition walls 4, include inner panels 5*a* which confront the internal regions of the oven space 'A' or oven compartment 'B', and outer panels 5*b* which confront spaces external to the oven space 'A' or oven compartment 'B'. Ventilation ports 7, which are formed in the wall members 5 of side parts 1, ceiling part 2, oven floor part 3, and partition wall 4, connect the internal space of each wall member 5 proximal to the inner panel 5*a* to the internal region of the oven space 'A' or oven compartment 'B'. Suction ports 8 connect the internal space of the wall members 5 proximal to the outer panels 5*b* to spaces external to the oven space 'A' or oven compartment 'B'.

Ventilation ports 7 may be formed as a punched hole, slit, or other type of orifice in the inner panel 5*a* entirely. Each suction port 8 is structured to include a joint part 18, to which a duct may be attached, connected to a hole formed through the upper, lower, right, left, or center portion of the outer panel 5*b*. Either ventilation port 7 or suction port 8 may be sealed by the attachment of a plug or other like sealing device (not illustrated in the drawings), the attachment of sealing device after the seasoning operation resulting in the internal space of the wall member 5 being sealed off from the external environment. In order to improve ventilation of the internal regions of the wall members 5, it is preferable that the number of ventilation ports 7 is greater than that of the suction ports 8.

The suction means 9, which may be a suction pump, fan, or other like device, is connected to the suction port 8 to evacuate the atmosphere within the wall member 5. The suction means 9 has the effect of ventilating the internal atmosphere of the oven space or oven compartments through the ventilation ports 7, and also evacuates the atmosphere within the wall members. The suction means 9 may be installed at a fixed position in proximity to the oven structure 15 and connected to the suction ports 8 on the side parts 1 and ceiling part 2 of the oven structure 15, and may also be installed to the cart 11 and connected to the suction ports 8 in the oven floor part 3. As illustrated in FIG. 2, in a case where the partition wall 4 is installed to the cart 11, the suction port 8 on the partition wall 4 is connected to the ventilation port 7 on the oven floor part 3 through a duct 19, therefore allowing the internal atmosphere of the partition wall 4 to be evacuated through the suction port 8 on the oven floor part 3.

The seasoning method is related to the structure in which the wall members 5 (which construct the side parts 1 and other oven wall parts delineating the internal and external regions of the oven space 'A' and the partition walls 4 defining the internal oven compartments 'B', and include inner panels 5*a* facing the internal regions of the oven space 'A' or internal oven compartment 'B' and outer panels 5*b* facing the external regions of the oven space 'A' or internal oven compartment 'B') are filled with thermal insulation 6. Sealable ventilation ports 7 are formed in the inner panels 5*a*, and sealable suction ports 8 are formed in the outer panels 5*b* of the wall members 5. The seasoning process is executed with the suction ports 8 and ventilation ports 7 open, thus allowing the suction means 9, which is connected to the suction ports 8, to evacuate the atmosphere within the wall members during the seasoning process.

During the seasoning process, the heater 16 heats the internal oven atmosphere which circulates within the oven space 'A' or oven compartments 'B' as a result of the operation of the circulation fan 17 and baffles 14. Suction means 9 draws this circulating high-temperature oven atmosphere, through the ventilation ports 7, into the wall members 5 where the heat of the drawn in atmosphere raises the temperature of the thermal insulation 6 in the wall members 5, and thus promotes the release of contaminants from the insulation 6. The operation of the suction means 9 draws the inner atmosphere within the wall member 5 containing the contaminants out, through the suction ports 8. As a result of this mechanism, the contaminants released from the thermal insulation 6 do not enter the oven space 'A' nor oven compartments 'B' during the seasoning process, but are discharged into the environment external to oven space 'A' and oven compartments 'B'.

The oven apparatus and oven seasoning methods provide means of maintaining the cleanliness of the internal environment of ovens by disposing of contaminants released from the thermal insulation 6 during the seasoning process. By utilizing the ventilation ports 7 and suction ports 8 formed in the wall members 5, the heated internal oven atmosphere may be drawn into the wall members 5 from where this atmosphere, which contains the contaminants released from the thermal insulation 6, is drawn out into the environment external to the oven space 'A' and oven compartments 'B'. A mechanism is thus formed whereby the contaminants released by the thermal insulation 6 may be disposed of during the oven break-in operation.

As a result of the released contaminants being discharged into an environment external to the oven space 'A' or oven compartments 'B', the contaminants are not allowed to enter the oven space 'A' and oven compartments 'B', thus eliminating the necessary task of cleaning oven space 'A' after the seasoning process. Moreover, this mechanism uses the high-temperature internal oven atmosphere to effectively raise the temperature of all of the insulation 6 within the wall members 5, thus making it possible to efficiently release and evacuate insulation contaminants during a shorter seasoning process regardless of the temperature differential between the internal and external oven environments. In addition, the only components required to realize the benefits of the invention are the ventilation ports 7 and suction ports 8 in the wall member 5, and the suction means 9. The structure of the oven apparatus thus remains simple and the cost of constructing an oven utilizing the invention is increased only minimally.

Figure 3:
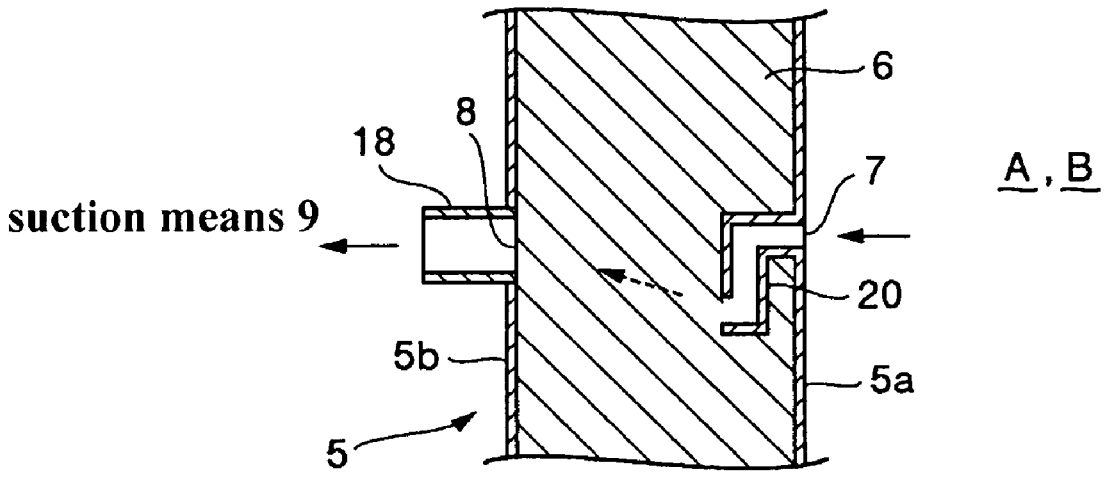
FIG. 3 is an enlarged cross-sectional view of a modification of a wall member described in FIGS. 1 and 2.
Figure 4:
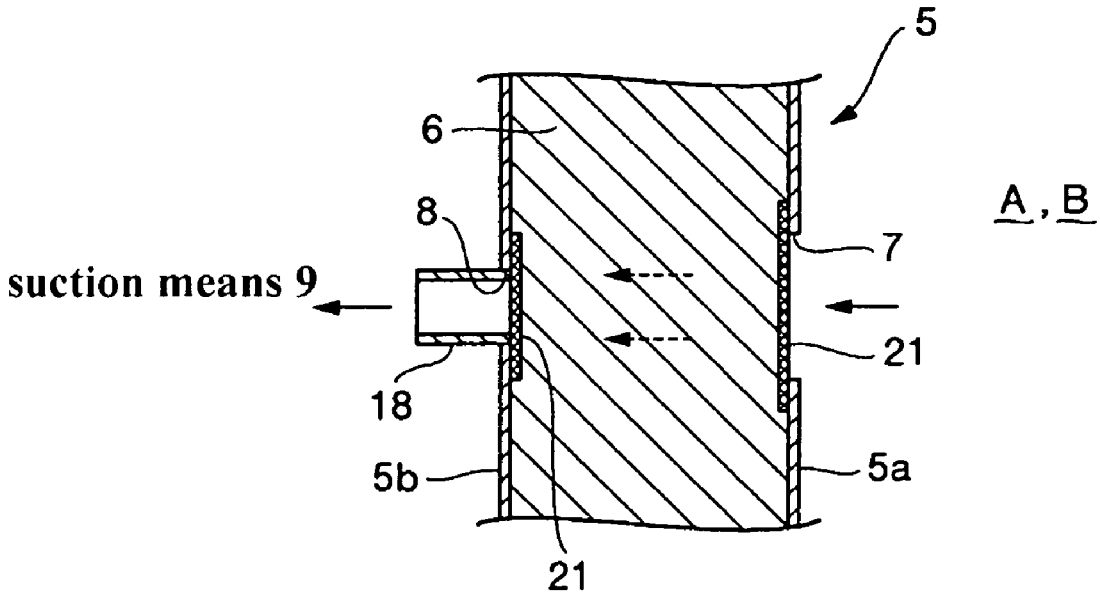
FIG. 4 is an enlarged cross-sectional view of an additional modification of the wall member described in FIG. 1 and 2.
Figure 5:
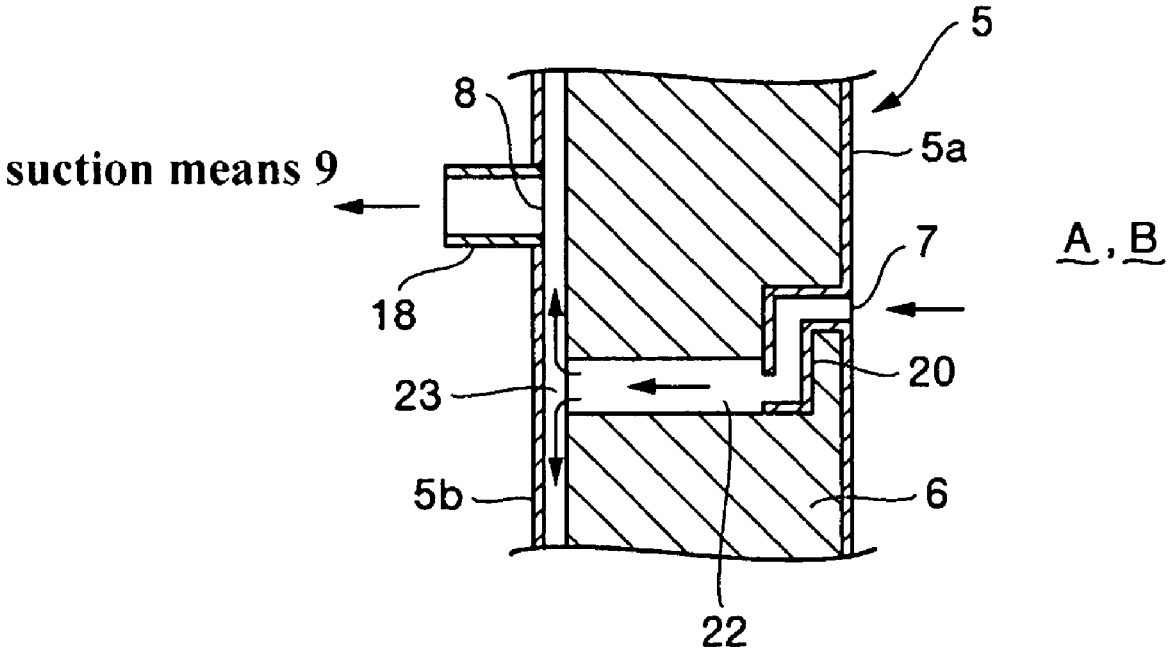
FIG. 5 is an enlarged cross-sectional view of a further additional modification of the wall member described in FIGS. 1 and 2.

FIGS. 3 through 5 illustrate modified versions of the above structure. FIG. 3 describes ventilation port 7 formed as a hole or slit to which a bending part, in the form of a bent duct 20, is provided as means of concealing the thermal insulation 6 in the wall member 5 from the oven space 'A' or oven compartment 'B'. Utilizing this structure, all that can be seen when looking into the wall member 5 from the oven space 'A', or looking into oven space 'A' from wall member 5, is the bent duct 20. More specifically, the bent duct 20 separates the thermal insulation 6 in the wall member 5 from the oven space 'A' or oven compartment 'B' as means of preventing pieces and particulate matter of the thermal insulation 6 from entering the oven space 'A' or oven compartment 'B'. This mechanism is thus provided which maintains the cleanliness of the internal oven environment.

The FIG. 4 describes a modification of the structure wherein a ventilated cover 21, which may be a net or other type of atmospherically permeable cover installed to the ventilation port 7 and the suction port 8. As in the previously described modification, the ventilated cover also prevents pieces and particulate matter from the thermal insulation 6 from entering the oven space 'A' and oven compartment 'B', and also prevents the suction means 9 from drawing in the pieces and particulate matter.

FIG. 5 describes another modified structure wherein a duct-like thru-passage 22, which connects the ventilation port 7 and suction port 8, is formed within the thermal insulation 6. A ventilating space 23, which connects to the suction port 8, is formed between the thermal insulation 6 and the outer panel 5*b* of the wall member 5 in order to provide ventilation which raises the temperature of the thermal insulation 6. As illustrated in the drawing, the thru-passage 22 is formed as a duct-like structure which connects to suction port 8 through the ventilating space 23. Because the ventilation flow may not be stable in cases where the thermal insulation 6 is relatively thick, thru-passage 22 provides means of smoothly directing the flow of the internal oven atmosphere from the ventilation port 7 into the wall member 5 from which the atmosphere may be discharged more smoothly through the suction port 8.

The ventilating space 23 also offers the advantage of raising the temperature of the external part of the oven, which is normally at a lower temperature than the internal part, by the flow of the high-temperature internal oven atmosphere through the wall member 5. This has the effect of heating the thermal insulation 6 from the outer panel 5*b* side. Therefore, contaminants may be efficiently removed from the thermal insulation 6, regardless of the temperature differential between the oven space 'A' and external environment, and thus allow for a shorter seasoning process.

The invention claimed is:

1. An oven apparatus comprising:

wall members which constitute an oven wall defining internal and external regions of an oven and partition walls forming oven compartments within the oven by defining internal and external regions thereof, the wall members including an inner wall panel facing an internal side of the oven or oven compartment, an outer wall panel facing the external side of the oven or oven compartment, and thermal insulation installed between the inner and outer wall panels, wherein a sealable ventilation port is formed on the inner wall panel, a sealable suction port is formed on the outer wall panel, and a suction-generator is connected to the suction port for evacuating the atmosphere within the wall member, and wherein heated internal oven atmosphere, which contains contaminants released from the thermal insulation, is drawn into the wall members and then is drawn out from the wall members and into external regions of the oven and oven compartments by evacuation of the suction-generator in an open condition of the ventilation and suction ports to release and dispose of the contaminants from the thermal insulation during an oven break-in operation.

2. The oven apparatus according to claim 1, wherein a bending part is attached to the ventilation port for concealing the thermal insulation within the wall member from the internal region of the oven or oven compartment.

3. The oven apparatus according to claim 1, wherein a ventilated cover is installed over the ventilation port or suction port.

4. The oven apparatus according to claim 1, wherein a thru-passage is formed within the thermal insulation in the form of a duct connecting the ventilation port and suction port.

5. An oven apparatus comprising:

wall members which constitute an oven wall defining internal and external regions of an oven and partition walls forming oven compartments within the oven by defining internal and external regions thereof, the wall members including an inner wall panel facing an internal side of the oven or oven compartment, an outer wall panel facing the external side of the oven or oven compartment, and thermal insulation installed between the inner and outer wall panels, wherein a sealable ventilation port is formed on the inner wall panel, a sealable suction port is formed on the outer wall panel, and a suction-generator is connected to the suction port for evacuating the atmosphere within the wall member, and wherein a ventilating space is provided between the thermal insulation and outer wall panel of the wall member and connected to the suction port to provide ventilation through which the temperature of the thermal insulation is increased.

6. A seasoning method utilized in conjunction with an oven apparatus comprising wall members which constitute an oven wall defining internal and external regions of an oven and partition walls forming oven compartments within the oven by defining internal and external regions thereof, the wall members having an inner wall panel facing the internal side of the oven or oven compartment, an outer wall panel facing the external side of the oven or oven compartment, and thermal insulation installed between the inner and outer wall panels, wherein a sealable ventilation port is installed on the inner wall panel of the wall members, a sealable suction port is installed on the outer wall panel of the wall members, the method comprising drawing heated internal oven atmosphere, which contains the contaminants released from the thermal insulation, into the wall members and then is drawn out from the wall members and into external regions of the oven and oven compartments by evacuating a suction-generator connected to the suction port in an open condition of the ventilation and suction ports, to release and dispose of contaminants from the thermal insulation, during a seasoning operation.

* * * * *